US006810854B2

(12) United States Patent
Stroh

(10) Patent No.: US 6,810,854 B2
(45) Date of Patent: Nov. 2, 2004

(54) METHOD AND APPARATUS FOR PREDICTING AND CONTROLLING MANIFOLD PRESSURE

(75) Inventor: David J. Stroh, Farmington Hills, MI (US)

(73) Assignee: General Motors Corporation, Detroit, MI (US)

( * ) Notice: Subject to any disclaimer, the term of this patent is extended or adjusted under 35 U.S.C. 154(b) by 81 days.

(21) Appl. No.: 10/277,360

(22) Filed: Oct. 22, 2002

(65) Prior Publication Data

US 2004/0074474 A1 Apr. 22, 2004

(51) Int. Cl.[7] ..... F02D 41/04; F02D 9/02; F02D 11/10; F02D 13/02

(52) U.S. Cl. ..... 123/399; 123/436

(58) Field of Search ..... 123/352, 361, 123/399, 435, 436, 478, 480, 486

(56) References Cited

U.S. PATENT DOCUMENTS 5,107,813 A * 4/1992 Inoue et al. ..... 123/435

6,499,449 B2 * 12/2002 Michelini et al. ..... 123/436

FOREIGN PATENT DOCUMENTS

JP 2002-303177 * 10/2002

OTHER PUBLICATIONS

Bishop, "Effect of Design Variables on Friction and Economy, " SAE Paper No. 812A, Jan. 1964, pp. 334–354.

* cited by examiner

*Primary Examiner*—Tony M. Argenbright
(74) *Attorney, Agent, or Firm*—Christopher DeVries

(57) ABSTRACT

A method and apparatus for converting a desired torque to a throttle area to generate the desired torque in an internal combustion engine including the steps of converting the desired torque to an air per cylinder value, converting the desired torque to an indicated mean effective pressure, converting the indicated mean effective pressure to a manifold pressure, and converting the manifold pressure to the throttle area.

13 Claims, 2 Drawing Sheets

METHOD AND APPARATUS FOR PREDICTING AND CONTROLLING MANIFOLD PRESSURE

TECHNICAL FIELD

The present invention relates to the control of internal combustion engines. More specifically, the present invention relates to a method and apparatus to control the torque of an internal combustion engine.

BACKGROUND OF THE INVENTION

In an engine torque-based control system, engine torque is controlled using throttle position, spark advance/retard, and the air/fuel mixture. An engine throttle directly regulates the power/torque produced by an internal combustion engine such a gasoline engine, as the angular position of a throttle plate controls the mass air flow through an internal combustion engine. Generally, the fuel mixed with the air entering the engine is controlled to increase proportionally to the air mass flow such that the power/torque of an internal combustion engine is directly proportional to the mass air flow through the engine.

SUMMARY OF THE INVENTION

The present invention is a method and apparatus for the control of engine torque. The present invention determines and controls the required air flow through the cylinder or "air-per-cylinder" necessary to deliver a requested torque.

DESCRIPTION OF THE PREFERRED EMBODIMENT

Figure 1:
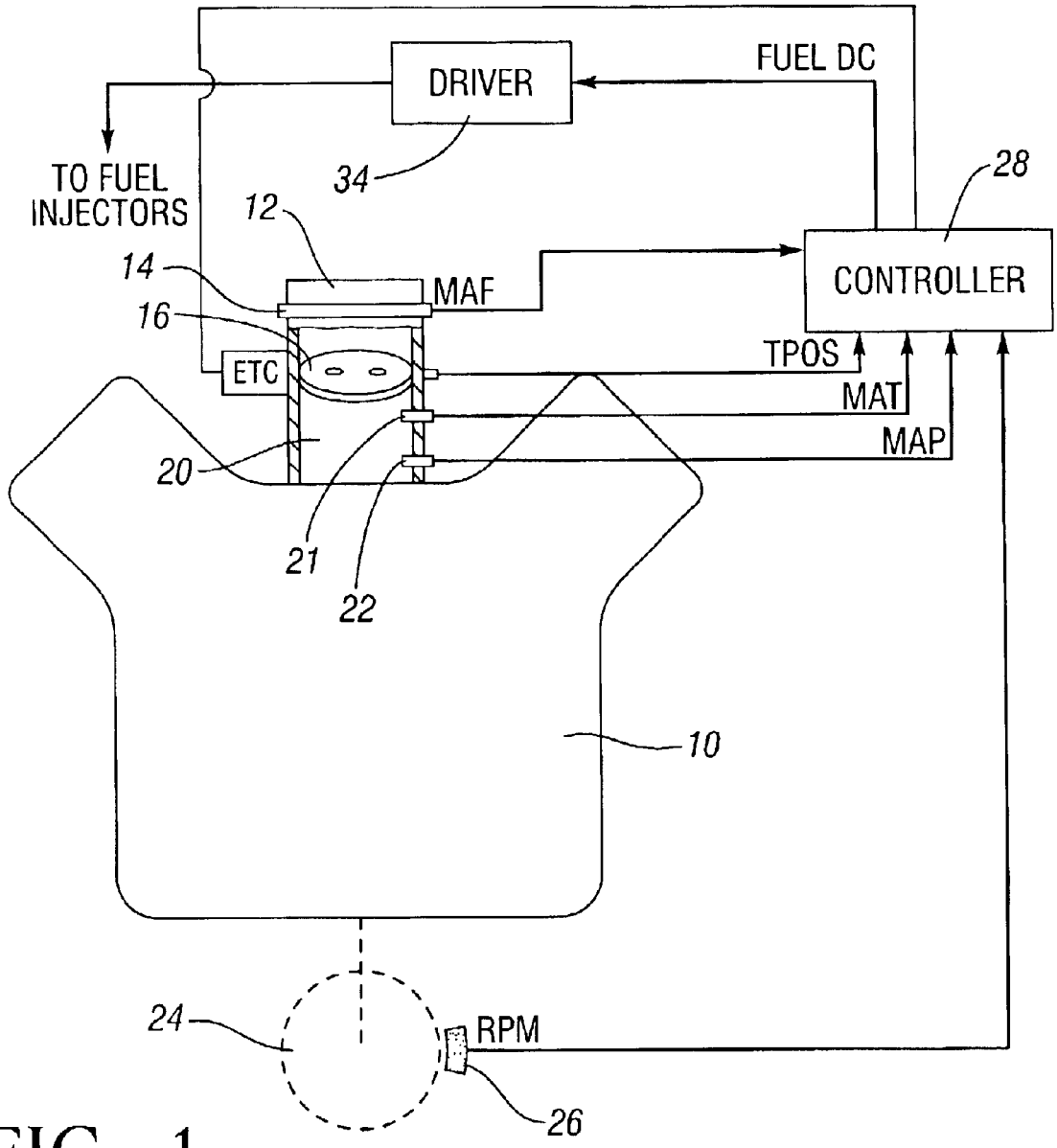
FIG. 1 is a diagrammatic drawing of the control system of the present invention.

FIG. 1 is a diagrammatic drawing of an internal combustion engine (ICE) control system used in the present invention. Air is provided to an ICE 10 through inlet air path commencing at inlet 12, and is passed from inlet 12 through mass airflow sensing means 14, such as a conventional mass airflow meter, that provides an output signal MAF indicative of the rate at which air passes through the sensing means. The inlet air is metered to the engine 10 via throttle valve 16, such as a conventional butterfly valve or electronic throttle, that rotates within the inlet air path in accordance with an operator-commanded engine operating point. Alternate embodiments of the present invention may include other types of throttling such as valve throttling. The rotational position of the valve is measured via throttle position sensor 18, which may be a generally known as a rotational potentiometer or encoder that communicates an output signal TPOS indicative of the rotational position of the valve 16. The rotational position corresponds to the throttle area. A manifold pressure sensor 22 is disposed in the inlet air path 20 such as in an engine intake manifold between the throttle valve 16 and the engine 10, to measure manifold absolute air pressure and communicate output signal MAP indicative thereof. A manifold air temperature sensor 21 is provided in the inlet air path 20 such as in the engine intake manifold to sense air temperature therein and communicate a signal MAT indicative thereof.

An engine output shaft 24, such as an engine crankshaft, rotates through operation of the engine 10 at a rate proportional to engine speed. Appendages or teeth (not shown) are spaced about a circumferential portion of the shaft 24. A tooth passage sensor 26, such as a conventional variable reluctance sensor or Hall effect sensor, is positioned with respect to the crankshaft teeth so as to sense passage of the teeth by the sensor. The teeth may be spaced about the circumference of the shaft 24 such that each passage of a tooth by the sensor 26 corresponds to an engine cylinder event. For example, in a four cylinder, four stroke engine, the shaft 24 may include two teeth equally spaced about the shaft circumference (180 degrees apart). Additional teeth may be included for synchronization of the teeth, as is generally understood in the engine control art. Sensor 26 provides an output signal RPM having a frequency proportional to engine speed in that each cycle of RPM may indicate a cylinder event of engine 10.

Controller 28, such as a conventional microcontroller or microprocessor, receives input signals including the described MAF, TPOS, MAP, MAT and RPM signals, and determines engine control commands in response thereto, to provide for control of engine operation, such as in a manner consistent with generally known engine control practices. For example, the input information may be applied in the control of the air-per-cylinder provided to the ICE 10. The air-per-cylinder is applied in a determination of throttle angle requirements. A throttle area may then be generated to deliver the desired air-per-cylinder. The desired throttle angle may be periodically output to the electronic throttle controller to rotate the throttle blade to the appropriate position.

In an engine-torque-based control system, it is desired to control the engine torque as accurately as possible given a torque reference. The available direct control parameters used to control torque, as previously described, are throttle plate area or position, spark advance/retard and the air/fuel mixture applied to an internal combustion engine (ICE). The present invention computes or maps a desired torque to the air-per-cylinder necessary to deliver the desired torque in an internal combustion engine. The relationship between the air-per-cylinder and engine torque is substantially linear, but the air-per-cylinder is an intermediate control parameter not directly controlled in the operation of an ICE. The present invention determines a transfer function between the direct control parameters and the control of the air-per-cylinder. In the preferred embodiment of the present invention, a transfer function converts the air-per-cylinder to the throttle position or area.

The transfer function linking throttle position and the air-per-cylinder utilizes a compressible flow equation that relates air mass flow, barometric pressure, manifold pressure, and throttle area. The equation is defined as follows:

$$A_eff=(mdot\times(R\times T_amb)^{1/2})/(P_amb\times phi) \quad (1)$$

where:

A_eff is the effective throttle area;

R is the universal gas constant;

T_amb is the ambient temperature;

P_amb is the barometric pressure;

mdot is the mass flow rate; and phi is defined as:

$$phi=(P_man/p_amb)^{(1/gamma)}\times\{(2\times\text{gamma}/(\text{gamma}-1)\times[1-(P_man/P_amb)^{((gamma-1)/gamma)}]\}^{1/2}$$

where:

P_man is the manifold pressure, and gamma is the ratio of specific heats for air The throttle area variable A_eff can be used to directly calculate the throttle position. Equation 1 is not directly applicable to the aforementioned transfer function problem as the value of two variables must be addressed. The mdot variable is not known, only the air-per-cylinder required to generate a desired torque. The manifold pressure value P_man is in a transient state, as it is continuously changing during normal engine operation.

The value of a desired mdot mass flow rate variable can be addressed by using the current engine speed measurement to calculate the mdot from a desired air-per-cylinder (corresponding to a desired torque or torque command) as follows:

$$mdot=air_per_cylinder\times N\times(no.\ \text{of cylinders}/120) \quad (2)$$

The value of the manifold pressure variable P_man can be addressed by using the current instantaneous manifold pressure. However, this poses a problem in response time due to the fact that this manifold pressure is a measure of where you are and not where you are heading (the desired P_man for a desired torque). Thus, an undesirable lag is introduced in the system that may impede the dynamic response.

Figure 2:
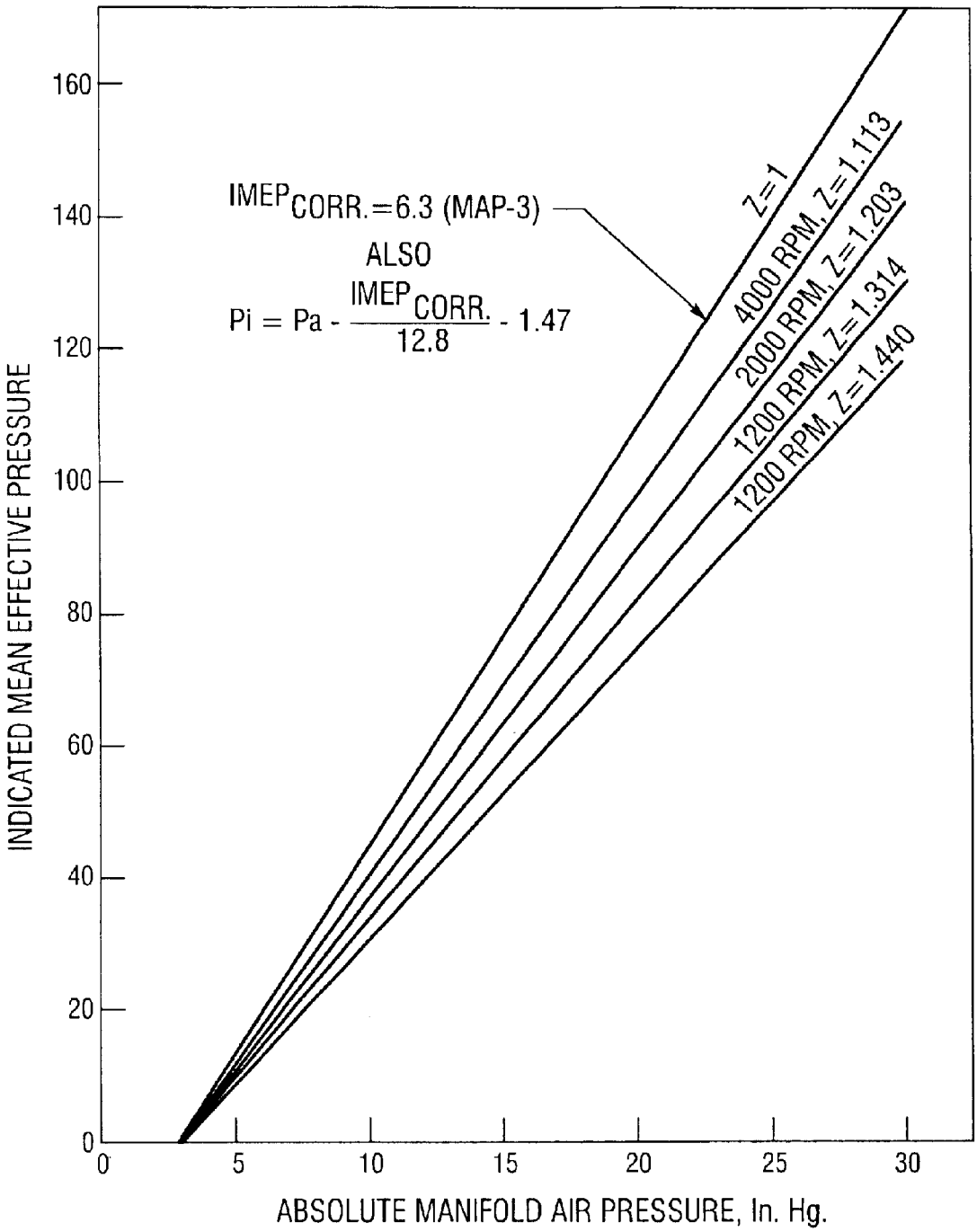
FIG. 2 is a plot of indicated mean effective pressure versus absolute manifold air pressure.

The present invention includes a method for predicting the desired manifold pressure to achieve the desired air-per-cylinder to alleviate the lag that results from using a current manifold pressure. The present invention converts the desired air-per-cylinder to desired cylinder indicated mean effective pressure or IMEP. The desired IMEP is an intermediate parameter linked to the desired MAP, or the MAP the engine control system is heading to at steady-state for a desired torque. By using IMEP, the present invention takes advantage of the relationships between IMEP and MAP to speed up the response for the system. IMEP is defined as the work done per cylinder volume or IMEP=Work/Cylinder_volume. The Work term can be calculated from the thermodynamic relationship:

$$Work=air_per_cylinder/(Air_Fuel_Ratio)\times Q_LHV\times eta_c \quad (3)$$

where:

Air_Fuel_Ratio is known (assuming stoichiometric operation or other known operating condition);

Q_LHV is an average lower heating value of the fuel; and eta_c is an average thermodynamic efficiency qualifying the amount of energy converted to useful work Using the value of IMEP, a relationship as seen in the graph of FIG. 2 can be used to determine manifold pressure based on the IMEP. FIG. 2 illustrates the steady-state relationship between IMEP and manifold pressure. As seen in FIG. 2, a dependence on RPMs does exist. This can be addressed by developing a family of curves for varying RPM or by developing a single relationship using a speed-corrected IMEP given as:

$$IMEP_c=IMEP\times \text{alpha}\times Z \quad (4)$$

where IMEPC is the speed corrected IMEP;

IMEP is the measured IMEP;

alpha is an empirically determined constant specific to the engine; and

Z is the speed correction factor.

The relationship between the speed-corrected IMEP and manifold pressure is described in the following equation:

$$IMEP_c=12.8\times(P_amb-P_man-1.47) \quad (5)$$

Using Equation 5, a predicted manifold pressure can be calculated that is closer to the actual value than that of a current manifold pressure reading. This is then used in equation (1) to calculate the required throttle area. Accordingly, the dynamic torque control of an ICE may be improved.

In an alternate embodiment of the present invention, the desired manifold pressure P_des may be calculated as follows. Using the ideal gas law, the following equation can be written:

$$P_des=air_per_cyl\times R\times T_amb/(eta_vol\times V_cyl) \quad (6)$$

where P_des is the desired manifold pressure;

air_per_cyl is the desired air-per-cylinder of the control system;

V_cyl is the cylinder volume; and eta_vol is the volumetric efficiency.

The volumetric efficiency eta_vol is known to be a strong function of engine speed and a weak function of manifold pressure. The present invention in one embodiment may store volumetric efficiency in a table with speed and MAP indices, and in a second embodiment calculate instantaneous volumetric efficiency on-line with information from the air meter and air-per-cylinder estimates.

Instantaneous calculation of the volumetric efficiency is based on the following equation:

$$eta_vol=air_per_cyl_est/(P_man\times V_cyl/(R\times T_amb)) \quad (7)$$

Inserting the above equation into the equation for P_des produces the following result:

$$P_des=P_man\times(air_per_cyl/air_per_cyl_est) \quad (8)$$

Equation 8 indicates that the desired manifold pressure is equal to the current manifold pressure adjusted by the ratio of the desired air-per-cylinder and the instantaneous air-per-cylinder estimate. Therefore, when the estimated air-per-cylinder is equal to the desired air-per-cylinder, this ratio is unity and the desired manifold pressure equates to the measured manifold pressure. For implementation, the multiplier defined as:

$$m=air_per_cyl/air_per_cyl_est \quad (9)$$

is filtered to avoid introducing noise to the system incurred from the estimated air-per-cylinder and to provide a means of controlling the dynamic system response.

While this invention has been described in terms of some specific embodiments, it will be appreciated that other forms can readily be adapted by one skilled in the art. Accordingly, the scope of this invention is to be considered limited only by the following claims.

I claim:

1. An engine control system in a vehicle comprising:

an internal combustion engine;

an intake manifold coupled to said internal combustion engine;

a manifold pressure sensor determining the manifold pressure of said internal combustion engine;

a controller for controlling said variable internal combustion engine;

wherein the torque of said internal combustion engine is controlled using the air-per-cylinder; and wherein the air-per-cylinder is controlled using indicated mean effective pressure.

2. The engine control system of claim 1 wherein said controller relates throttle position to manifold pressure.

3. The engine control system of claim 2 wherein said controller relates indicated mean effective pressure to manifold pressure in the internal combustion engine.

4. The engine control system of claim 2 wherein said controller relates manifold pressure to indicated mean effective pressure.

5. The engine control system of claim 1 wherein said internal combustion engine is an eight-cylinder engine.

6. The engine control system of claim 1 wherein said internal combustion engine is an overhead valve engine.

7. The engine control system of claim 1 wherein said internal combustion engine is an overhead cam engine.

8. A method of controlling the torque of an internal combustion engine comprising the step of:

determining a desired manifold pressure for generating a desired torque; and converting an equivalent indicated mean effective pressure to the desired manifold pressure.

9. The method of claim 8 further comprising the step of converting the desired manifold pressure to a throttle position.

10. The method of claim 8 further comprising the steps of:

mapping the desired torque to a desired air per cylinder; and mapping the desired air per cylinder to the desired manifold pressure.

11. A method of converting a desired torque to a throttle area to generate the desired torque in an internal combustion engine comprising the steps of:

converting the desired torque to an air per cylinder value;

converting the desired air per cylinder value to an indicated mean effective pressure;

converting the indicated mean effective pressure to a manifold pressure; and converting the manifold pressure to the throttle area.

12. The method of claim 11 wherein the step of converting desired torque to an air per cylinder value comprises mapping the desired torque to an air per cylinder value in a controller.

13. The method of claim 11 further comprising the step of positioning a throttle to attain a desired throttle area.

* * * * *